US008033111B2

(12) United States Patent
Maeding

(10) Patent No.: US 8,033,111 B2
(45) Date of Patent: Oct. 11, 2011

(54) DAMPING OF VIBRATION OF A COMBUSTION CHAMBER BY RESONATORS

(75) Inventor: Udo Maeding, Unterschleissheim (DE)

(73) Assignee: Astrium GmbH, Breman (DE)

( * ) Notice: Subject to any disclaimer, the term of this patent is extended or adjusted under 35 U.S.C. 154(b) by 877 days.

(21) Appl. No.: 10/599,983

(22) PCT Filed: Apr. 7, 2005

(86) PCT No.: PCT/DE2005/000622

§ 371 (c)(1),
(2), (4) Date: Mar. 17, 2008

(87) PCT Pub. No.: WO2005/100858

PCT Pub. Date: Oct. 27, 2005

(65) Prior Publication Data

US 2008/0245072 A1 Oct. 9, 2008

(30) Foreign Application Priority Data

Apr. 17, 2004 (DE) ..... 10 2004 018 725

(51) Int. Cl.
*F02C 7/24* (2006.01)

(52) U.S. Cl. ..... 60/725; 181/213; 431/114

(58) Field of Classification Search ..... 60/725; 181/213, 207–208, 222; 431/114
See application file for complete search history.

(56) References Cited

U.S. PATENT DOCUMENTS

| | | | | | |
|---|---|---|---|---|---|
| 2,738,781 | A * | 3/1956 | Bodine, Jr. | 123/265 |
| 3,200,589 | A * | 8/1965 | Mower et al. | 60/39.461 |
| 3,426,409 | A * | 2/1969 | Lewis | 29/890.01 |
| 3,483,698 | A * | 12/1969 | Ford et al. | 60/725 |
| 3,782,116 | A * | 1/1974 | Burge et al. | 60/258 |
| 4,175,919 | A * | 11/1979 | Matsumoto et al. | 431/114 |
| 4,621,492 | A * | 11/1986 | von Pragenau | 60/258 |
| 5,353,598 | A | 10/1994 | Huck et al. | |
| 5,404,715 | A * | 4/1995 | Vuillamy et al. | 60/257 |
| 5,489,202 | A * | 2/1996 | Eisinger | 431/114 |
| 5,685,157 | A | 11/1997 | Pandalai et al. | |
| 5,899,388 | A * | 5/1999 | Sion et al. | 239/424 |
| 6,918,243 | B2 * | 7/2005 | Fisher | 60/211 |
| 7,334,408 | B2 * | 2/2008 | Bethke et al. | 60/725 |
| 2002/0152751 | A1 * | 10/2002 | Mandai et al. | 60/746 |

FOREIGN PATENT DOCUMENTS

| | | |
|---|---|---|
| DE | 3432607 | 3/1986 |
| DE | 10163561 | 7/2003 |

OTHER PUBLICATIONS

English Language Abstract of DE 34 32 607.
English Language Abstract of DE 101 63 561.

* cited by examiner

*Primary Examiner* — Louis Casaregola
*Assistant Examiner* — Phutthiwat Wongwian
(74) *Attorney, Agent, or Firm* — Greenblum & Bernstein, P.L.C.

(57) ABSTRACT

Device for damping oscillations of a combustion chamber that includes at least one resonator connected to a pre-chamber in a vibration-damping manner. The pre-chamber is connected to a combustion chamber in a vibration-damping manner via at least one passage channel. This abstract is not intended to define the invention disclosed in the specification, nor intended to limit the scope of the invention in any way.

19 Claims, 4 Drawing Sheets

DAMPING OF VIBRATION OF A COMBUSTION CHAMBER BY RESONATORS

CROSS-REFERENCE TO RELATED APPLICATIONS

The present application is a U.S. National Stage of International Patent Application No. PCT/DE2005/000622 filed Apr. 7, 2005 which published as WO 2005/100858 on Oct. 27, 2005, and claims priority of German Patent Application No. DE 10 2004 018 725.8 filed Apr. 17, 2004.

BACKGROUND OF THE INVENTION

1. Field of the Invention

The present invention relates to a device for damping oscillations of a combustion chamber, whereby at least one resonator is connected to the combustion chamber in a vibration-damping manner.

2. Discussion of Background Information

Devices of this type are known in principle from the prior art. DE 34 32 607 A1 and U.S. Pat. No. 5,353,598 A describe devices for damping oscillations of a combustion chamber, whereby at least one resonator or one damping chamber is connected directly or via passage channels to the combustion chamber of a rocket engine.

However, a disadvantage of the devices according to U.S. Pat. No. 5,353,598 A is that the resonators are directly connected to the combustion chamber of the rocket engine. An overheating of the resonators can therefore occur due to hot combustion gases entering from the combustion chamber area. As a result, the resonators lose their resonance effect, and accordingly, can no longer help to damp oscillations of the combustion chamber.

In DE 34 32 607 A1, damping chambers are arranged in the area of the injection head in a fuel distribution chamber and are connected to the combustion chamber via passage channels in a vibration-damping manner. An active cooling of the damping chambers is ensured through the arrangement in the fuel distribution chamber, which is used, e.g., for distributing hydrogen. However, relatively complex constructive measures are required. Nevertheless, it cannot be ruled out that hot combustion chamber combustion gases penetrate via the passage channels directly into the damping chambers and lead to the impairment or even destruction of the damping chambers.

SUMMARY OF THE INVENTION

An object of the present invention is therefore to provide an improved way of damping oscillations of a combustion chamber with the aid of resonators.

The invention is directed to a device for damping oscillations of a combustion chamber, whereby at least one resonator is connected to the combustion chamber in a vibration-damping manner. According to the invention, the at least one resonator is connected to a pre-chamber in a vibration-damping manner and the pre-chamber is connected via at least one passage channel to the combustion chamber in a vibration-damping manner. As a result, the resonator(s) that are used to damp the oscillations are no longer in direct contact with the combustion chamber, or with the interior of the combustion chamber. Instead, there is only one indirect connection via the intermediate pre-chamber. The resonators can therefore be arranged in areas that are subjected to a lower thermal stress or smaller temperature changes. Since the oscillations of the combustion chamber can reach as far as the resonators via the passage channel and the pre-chamber, the oscillations of the combustion chamber can be effectively damped.

A first further development of the invention provides that the combustion chamber adjoins an injection head with at least one injection element, wherein injection head is embodied to conduct a fuel flow into the combustion chamber, and the pre-chamber is fluidically arranged before the at least one injection element. A single fuel flow can thereby be provided, which is fed to the combustion chamber. Two or more fuel flows can also be provided, which are fed through the injection elements to the combustion chamber and optionally are already mixed in or immediately after the injection elements. Utilizing this alternative, the pre-chamber is arranged in an area through which at least one of the fuel flows passes before flowing through the injection element(s). The injection elements therefore lie between the combustion chamber or the interior of the combustion chamber, and the pre-chamber.

However, as an alternative, the invention also provides that the combustion chamber adjoins an injection head with at least one injection element, which injection head is embodied to conduct a fuel flow into the combustion chamber, and the pre-chamber is arranged fluidically in the area of the at least one injection element. The pre-chamber therefore lies in an area through which at least one of the fuel flows passes while flowing through the injection element(s). The injection elements and the pre-chamber are therefore arranged fluidically next to one another in front of the combustion chamber or the interior of the combustion chamber.

In both cases, at least one of the fuel flows can be used to keep the temperature of the resonators largely constant through an active cooling of the resonators. For this, in particular, the pre-chamber can be connected fluidically to a fuel flow, before it reaches the interior of the combustion chamber. The fuel flow is thereby not merely guided around a resonator as, e.g., in the case of DE 34 32 607 A1, but it reaches the interior of the resonator so that the resonance volume of the resonator itself can be kept largely constant at the temperature of the fuel flow. Ideally, the resonator as well as the pre-chamber is connected to a gaseous fuel flow. As such, a particularly good vibration-damping connection between resonator and combustion chamber can be ensured via the fuel flow.

It is preferably provided that the passage channel is embodied as part of an injection element. However, in principle separate passage channels can also be provided which guarantee a vibration-damping connection between the interior of the combustion chamber and the pre-chamber.

The resonators can be embodied, e.g., as a spherical resonator or as a $\lambda/4$ resonator. Resonators of this type are sufficiently known in principle from the prior art.

The invention also provides for a device for damping oscillations of a combustion chamber comprising at least one resonator connected to a pre-chamber in a vibration-damping manner. The pre-chamber is connected to a combustion chamber in a vibration-damping manner via at least one passage channel.

The combustion chamber may adjoin an injection head having at least one injection element. The injection head may conduct a fuel flow into the combustion chamber. The pre-chamber may be arranged upstream of the at least one injection element. The pre-chamber may be arranged an area of the at least one injection element. The pre-chamber may be in fluid connection with a fuel flow. The at least one passage channel may be part of an injection element. The combustion chamber may be part of a rocket engine.

The invention also provides for a system for damping oscillations, wherein the system comprises a combustion chamber, an injection head arranged upstream of the combustion chamber, a pre-chamber arranged upstream of the injection head, and at least one resonator structured and arranged to dampen vibrations of the combustion chamber and comprising one of an opening communicating with the pre-chamber and an opening communicating with an open area of the injection head.

The combustion chamber may comprise an outlet arranged opposite the injection head. The opening communicating with the pre-chamber may comprise a circumferential opening. The at least one resonator may have annular shaped. The at least one resonator may comprise a sleeve which extends into the open area of the injection head. The at least one resonator may comprise a sleeve oriented along a direction of gas flow and which extends into the open area of the injection head. The at least one resonator may comprise a plurality of sleeves at least one of oriented along a direction of gas flow and extending into the open area of the injection head. The at least one resonator may comprise a radially oriented opening communicating with the pre-chamber. The at least one resonator may comprise a plurality of radially oriented openings communicating with the pre-chamber. The at least one resonator may comprise a radially oriented opening communicating with the open area of the injection head. The at least one resonator may be one of integrally formed in a side wall of the pre-chamber, integrally formed in an end wall of the pre-chamber, and integrally formed in a side wall of the injection head.

The invention also provides for a system for damping oscillations of a rocket engine, wherein the system comprises a combustion chamber, an injection head arranged upstream of the combustion chamber, a pre-chamber arranged upstream of the injection head, and at least one resonator structured and arranged to dampen vibrations of the combustion chamber and comprising one of an opening communicating with the pre-chamber and an opening communicating with an open area of the injection head.

BRIEF DESCRIPTION OF THE DRAWINGS

Exemplary embodiments of the present invention is described below on the basis of FIGS. 1 through 4 using the example of a rocket engine, wherein.

DETAILED DESCRIPTION OF THE INVENTION

Figure 1:
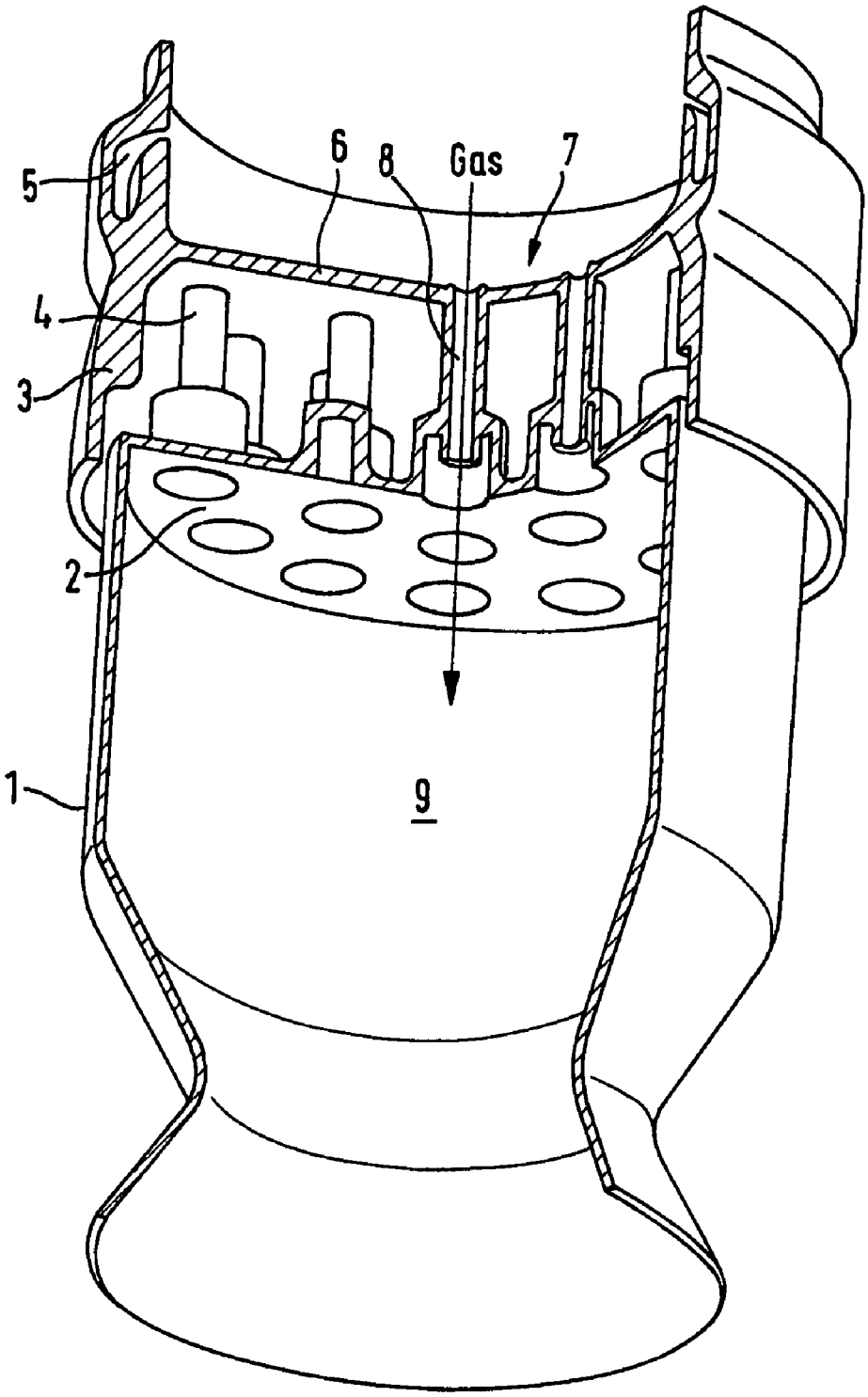
FIG. 1 shows a rocket engine with spherical resonator in front of the injection heads.

During the combustion of fuels in rocket engine chambers, the formation of different high-frequency oscillations often occurs during operation. Due to the high thermal and mechanical stress, such oscillations lead to damage or even the destruction of the rocket engine if they are not damped promptly.

One method for damping such oscillations relates to the use of acoustic resonators known from the prior art cited at the outset. A distinction is made here between spherical resonators and λ/4 resonators. Both resonator types comprise small volumes that are directly connected to the chamber in the case of the devices according to the prior art. A dissipation of the oscillation energy occurs in these resonators when the excited frequency of the chamber coincides with the natural frequency of the resonator. Resonators are narrow-band absorbers and, for this reason, have to be adjusted to the frequency to be damped. Spherical resonators are used for damping in a broader frequency range compared to the λ/4 resonators, which have to be adjusted to a discrete frequency. In both cases, in addition to the dependence on the geometric dimensions, there is also a strong dependence on the sound velocity and thus on the temperature. There is therefore a danger of a shift of the damping frequency through the heating up of the gas in the resonators. Moreover, the precise adjustment, particularly of the more effective λ/4 resonators, is more complex, since the temperature conditions in the resonators can be determined only experimentally and so a readjustment is necessary in most cases. Furthermore, systems of this type are associated with additional constructive expenditure due to the combustion chamber cooling problems present anyway in this area. Resonators arranged axially above the combustion chamber, i.e., against the direction of flow, in the area of the injection head form undesirable return flow zones in this area, whereby an additional heat flow forms in the direction of the injection head, which can impact the stability of the injection head.

The present invention provides a resonator arrangement that is independent of the hot combustion gases and thus of the temperature in the combustion chamber. At the same time, a negative impact of the arrangement of the injection elements and the combustion chamber cooling is avoided. The invention is particularly applicable in the case of full-flow engines and other engines with gaseous injection of one of two or more fuel components. With full-flow engines, gaseous combustion gases of a fuel turbine are fed to a fuel flow (full flow) again and guided together with the fuel flow into the combustion chamber. Another possible application is represented by expander cycle engines in which the drive of the fuel turbine takes place with a gaseous fuel such as hydrogen. Beforehand the fuel is guided in liquid form through cooling channels of the rocket engine and transferred in a gaseous state due to the heat absorption. With both types of engines, gaseous fuel flows are thus present which are guided via injection elements into the interior of a combustion chamber and combusted there.

Figure 2:
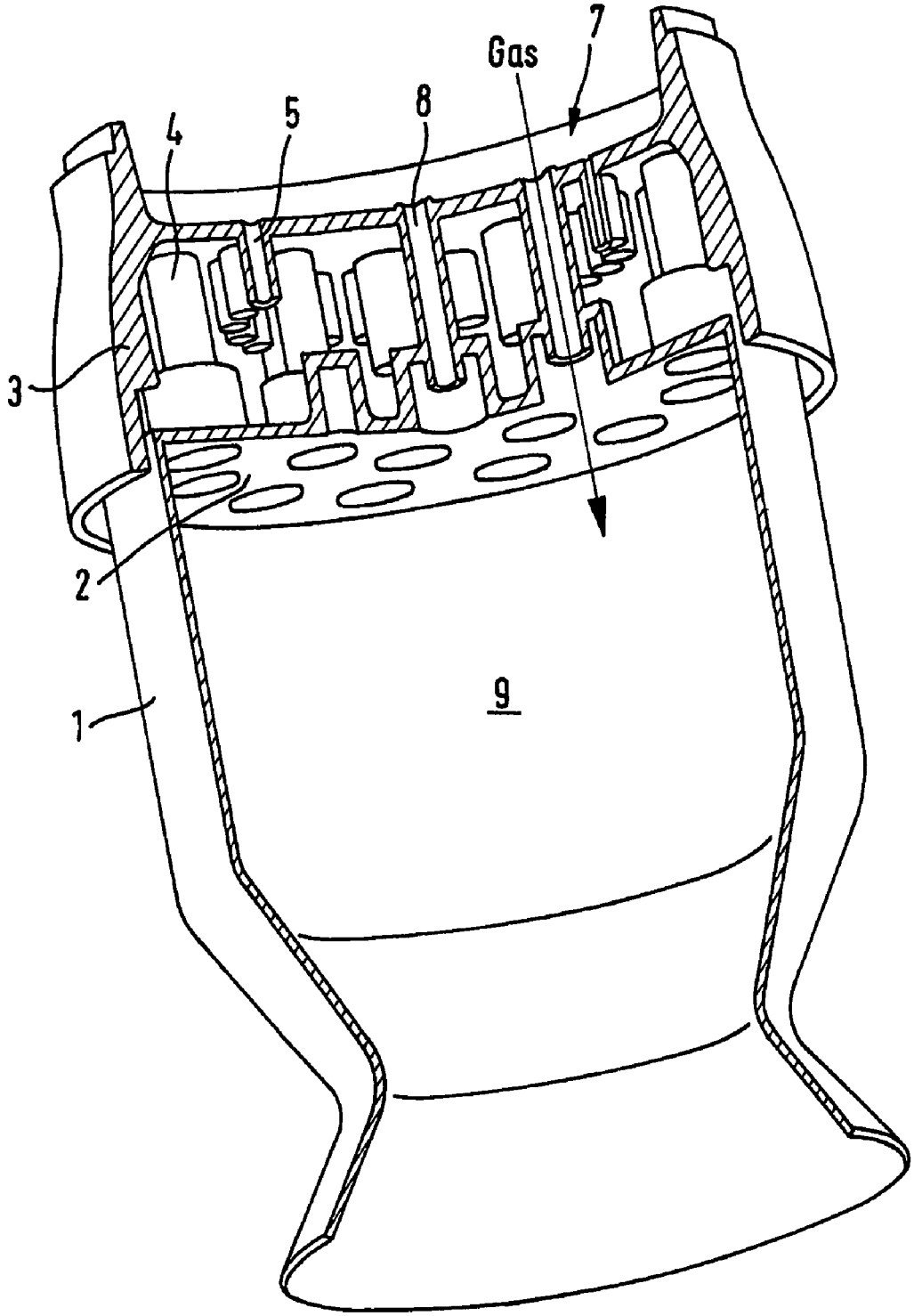
FIG. 2 shows a rocket engine with λ/4 resonators in an injection head cover plate.
Figure 3:
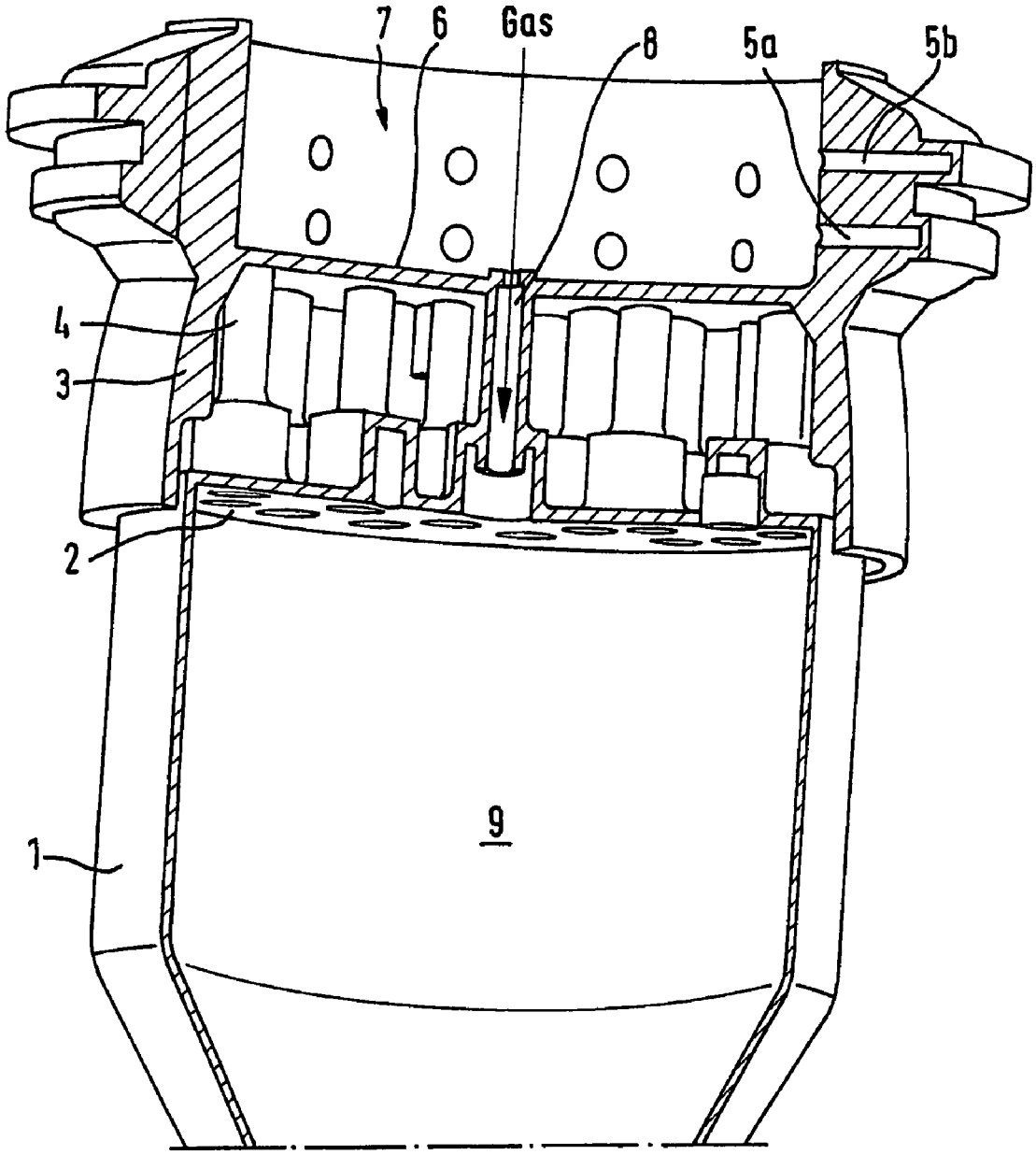
FIG. 3 shows a rocket engine with double-row λ/4 resonators in front of the injection head.

FIGS. 1 through 3 show examples of a full-flow rocket engine. The engine has respectively one combustion chamber 1 that is delimited upstream by an injection plate 2 of an injection head 3. Injection elements 4 are arranged in this injection head 3, which injection elements are used to guide one or more fuel flows into the interior 9 of the combustion chamber 1. The injection head 3 is delimited upstream by a cover plate 6. The injection elements 4 are embodied in a tubular manner, but they can also be formed by a combination of tubes and one or more coaxial sleeves. The injection elements 4 or the tubes or sleeves are connected to the injection plate 2 and/or the cover plate 6. The full flow of a gaseous fuel and turbine exhaust gases (gas) reach a pre-chamber 7 before the injection head 3 and are then guided through the injection elements 4 into the interior 9 of the combustion chamber 1.

Figure 4:
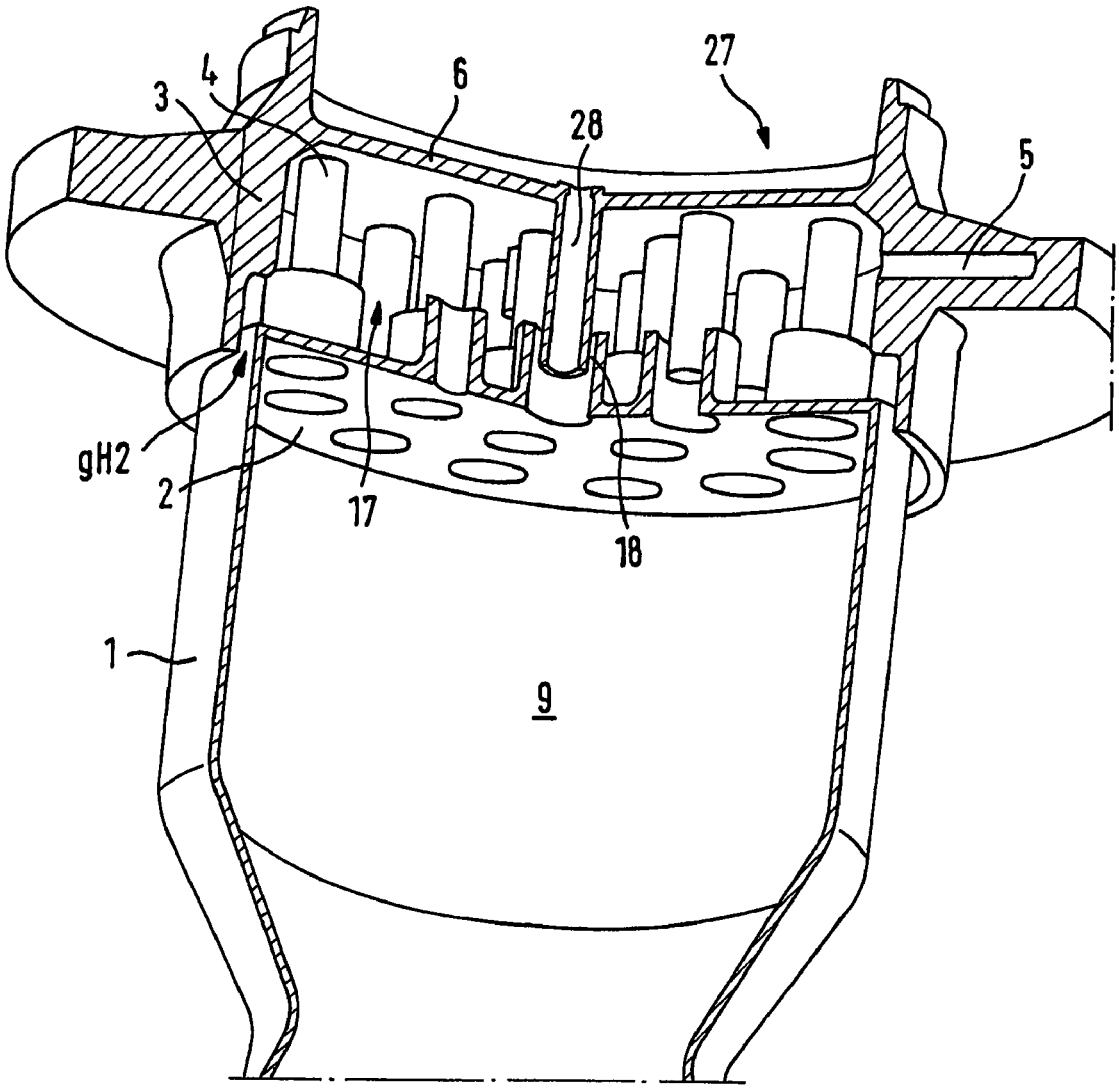
FIG. 4 shows a rocket engine with λ/4 resonators in the injection head.

FIG. 4 shows, in contrast, an expander cycle engine in which a gaseous fuel flow such as hydrogen (gH2) is guided into a pre-chamber 17 and from there reaches the interior 9 of the combustion chamber via annular gaps 18 between a tube 28 and a sleeve of a coaxial injection element 4. Another, e.g., liquid, fuel flow such as liquid oxygen reaches the interior 9 of the combustion chamber 1 via another chamber 27 and the tube 28.

High-frequency oscillations that develop in the combustion chamber 1 during the combustion of the fuel or fuels, are propagated upstream via fuel gas flows that flow through the injection elements 4 up to a pre-chamber 7, 17. A damping of the oscillations of the combustion chamber 1 according to the invention can thus also occur in that resonators 5, 5*a*, 5*b* are arranged in the area of the pre-chambers 7, 17 so that they communicate fluidically with the pre-chamber 7, 17.

In FIG. 1, a spherical resonator 5 is arranged in the wall of the pre-chamber 7. The spherical resonator 5 can thereby be embodied as an annular circumferential chamber in the wall of the pre-chamber 7. As such, the chamber is connected to the pre-chamber 7 via an annular passage gap.

In FIG. 2, which shows an alternative embodiment, λ/4 resonators 5, in the form of cylinders open on one side, are arranged in the cover plate 6 of the injection head 3. As shown in FIG. 2, several λ/4 resonators 5 can be arranged so as to be distributed uniformly. As is apparent from FIG. 2, the λ/4 resonators 5 are arranged in an annular manner around the central axis of the cover plate 6.

In FIG. 3 an arrangement of λ/4 resonators 5*a*, 5*b* is provided in the wall of the pre-chamber 7. The λ/4 resonators 5*a*, 5*b* are thereby embodied as bores in the wall of the pre-chamber 7. These λ/4 resonators 5*a*, 5*b* can also be arranged so as to be uniformly distributed. As is apparent from FIG. 3, the λ/4 resonators 5*a*, 5*b* have the form of two rings lying one above the other in the wall of the pre-chamber 7.

In the embodiments of FIGS. 2 and 3, in principle, all the λ/4 resonators 5, 5*a*, 5*b* can be embodied identically in order to damp precisely a defined oscillation frequency. However, the λ/4 resonators 5, 5*a*, 5*b* can also preferably be embodied differently, so that respectively one group of λ/4 resonators 5, 5*a*, 5*b* can be adapted to a specific oscillation frequency. In the case of FIG. 3, the lower λ/4 resonators 5*a* are embodied as shorter bores and thus adapted to higher oscillation frequencies than the upper λ/4 resonators 5*b*, which are embodied as longer bores.

With the use of a resonator arrangement of this type, an adjustment is made to the respective frequency to be damped, i.e., $f_{(chamber)}=f_{(resonator)}$. The determination of the geometric dimensions needs to take into account the respective temperature conditions of the gas in the area of the resonators, since this has a direct influence on the sound velocity and thus also on the frequency.

The same applies in principle to the exemplary embodiment shown in FIG. 4. Here λ/4 resonators 5 have the form of bores in the wall of the injection head 3 in the area of a pre-chamber 7, which encloses the injection elements 4. Here, too, the λ/4 resonators 5 can be arranged so as to be uniformly distributed, e.g., in an annular manner, in the wall of the injection head 3 and here, too, several groups of λ/4 resonators 5 can be present with different adjustment to different oscillation frequencies. As already described, gaseous fuel such as gH2 enters the pre-chamber 7 and is guided via annular gaps 8 into the interior 9 of the combustion chamber 1. This flow path of the gaseous fuel represents a vibration-damping connection between the interior 9 of the combustion chamber 1 and the pre-chamber 7, analogous to the statements above on FIGS. 1 through 3. These oscillations thus reach up to the λ/4 resonators 5 in the wall of the pre-chamber 7, and can there be effectively damped by the resonator effect of the λ/4 resonators 5.

The essential advantage of the invention lies in the largely constant temperature of the gas in the resonators 5, 5*a*, 5*b* for the entire duration of the operation of the engine. Furthermore, a simplification of the construction results in the high-temperature area of the combustion chamber 1, since no further arrangements such as resonators have to be provided, apart from the usual cooling, in the area of the wall of the combustion chamber 1 and in the injection plate. Moreover the construction according to the present invention makes it possible to accommodate a much larger number of resonator examples, since the individual exemplary embodiments according to FIGS. 1 through 3 can also be combined so that spherical resonators 5 and/or λ/4 resonators 5*a*, 5*b* can be provided in the wall of the pre-chamber 7 and/or λ/4 resonators 5 in the cover plate 6.

The invention claimed is:

1. A device for damping oscillations of a combustion chamber comprising:

at least one resonator structured arranged to dampen vibrations in fluid communication with a pre-chamber, an injector head having at least one passage channel, an open area and at least one injector element, the injector element extended through the open area to supply fuel to the combustion chamber.

wherein the pre-chamber is connected to the combustion chamber to dampen vibrations via the at least one passage channel.

2. The device of claim 1, wherein the combustion chamber adjoins the injection head.

3. The device of claim 2, wherein the injection head conducts the fuel flow into the combustion chamber.

4. The device of claim 3, wherein the pre-chamber is arranged upstream of the at least one injection element.

5. The device of claim 3, wherein the pre-chamber is arranged an area of the at least one injection element.

6. The device of claim 1, wherein the at least one passage channel is part of the injection element.

7. The device of claim 1, wherein the combustion chamber is part of a rocket engine.

8. A system for damping oscillations, the system comprising:

a combustion chamber;

an injection head having at least one injector tube to inject fuel to the combustion chamber;

a pre-chamber supply the fuel to the injection head; and at least one resonator structured and arranged to dampen vibrations of the combustion chamber and comprising one of:

an opening in fluid communicating with the pre-chamber; and an opening in fluid communicating with an open area of the injection head.

9. The system of claim 8, wherein the combustion chamber comprises an outlet arranged opposite the injection head.

10. The system of claim 8, wherein the opening communicating with the pre-chamber comprises a circumferential opening.

11. The system of claim 8, wherein the at least one resonator is annular shaped.

12. The system of claim 8, wherein the at least one resonator comprises a sleeve which extends into the open area of the injection head.

13. The system of claim 8, wherein the at least one resonator comprises a sleeve oriented along a direction of gas flow and which extends into the open area of the injection head.

14. The system of claim 8, wherein the at least one resonator comprises a plurality of sleeves at least one of oriented along a direction of gas flow and extending into the open area of the injection head.

15. The system of claim 8, wherein the at least one resonator comprises a radially oriented opening communicating with the pre-chamber.

16. The system of claim 8, wherein the at least one resonator comprises a plurality of radially oriented openings communicating with the pre-chamber.

17. The system of claim 8, wherein the at least one resonator comprises a radially oriented opening communicating with the open area of the injection head.

18. The system of claim 8, wherein the at least one resonator is one of:

integrally formed in a side wall of the pre-chamber;

integrally formed in an end wall of the pre-chamber; and integrally formed in a side wall of the injection head.

19. A system for damping oscillations of a rocket engine, the system comprising:

a combustion chamber;

an injection head having at least one injector tube to inject fuel to the combustion chamber;

a pre-chamber supply the fuel to the injection head; and at least one resonator structured and arranged to dampen vibrations of the combustion chamber and comprising one of:

an opening in fluid communicating with the pre-chamber; and an opening in fluid communicating with an open area of the injection head.

* * * * *